United States Patent [19]

Duncan

[11] Patent Number: 4,501,067

[45] Date of Patent: Feb. 26, 1985

[54] RAZORS AND SHAVING UNITS FOR RAZORS

[75] Inventor: David S. Duncan, London, England

[73] Assignee: Wilkinson Sword Limited, High Wycombe, England

[21] Appl. No.: 478,178

[22] Filed: Mar. 23, 1983

[30] Foreign Application Priority Data

Apr. 3, 1982 [GB] United Kingdom ..... 8209979
Dec. 6, 1982 [GB] United Kingdom ..... 8234699

[51] Int. Cl.[3] ..... B26B 21/14; B26B 21/00; B26B 21/08; B26B 21/28

[52] U.S. Cl. ..... 30/63; 30/47; 30/77; 30/61

[58] Field of Search ..... 30/61, 63, 77, 78, 79, 30/81, 84, 50, 47

[56] References Cited

U.S. PATENT DOCUMENTS

| | | | |
|---|---|---|---|
| 3,101,536 | 8/1963 | Bringewald | 30/61 |
| 3,224,090 | 12/1966 | Kruger et al. | 30/63 |
| 3,703,764 | 11/1972 | Perry | 30/47 |
| 3,793,725 | 2/1974 | Dawidowics | 30/63 |
| 3,871,077 | 3/1975 | Nissen | 30/77 |
| 3,964,159 | 6/1976 | Ferraro | 30/50 |
| 4,378,633 | 4/1983 | Jacobson | 30/77 |

*Primary Examiner*—Paul A. Bell
*Assistant Examiner*—Paul M. Heyrana
*Attorney, Agent, or Firm*—John K. Williamson

[57] ABSTRACT

A razor blade assembly, in the form of a razor or shaving unit, comprises a top cap 114, a razor blade 113 fixed relative to the top cap, and a guardbar 115 which is pivotally movable relative to the blade from a shaving position, in which the blade is exposed for shaving, to a protecting position in which the guardbar prevents contact between the cutting edge of blade 113 and a user of the razor. The guardbar can be formed integrally with a platform 112 on which a second blade 123 is secured, or the second blade 123 could be secured to the top cap. In either case the guardbar and platform will pivot between the shaving position and the protecting position, and in latter position both blades will be protected.

4 Claims, 11 Drawing Figures

RAZORS AND SHAVING UNITS FOR RAZORS

BACKGROUND OF THE INVENTION

This invention relates to a razor blade assembly, in the form of a complete razor or a shaving unit for a razor. By 'shaving unit' is meant a blade assembly which can be mounted on or formed integrally with a handle or a razor frame to provide a complete razor. In particular the invention relates to a disposable razor, that is to say one that is intended to be disposed of by the user when he considers that the razor is no longer giving an adequate shave. More particularly, the invention relates to the provision, in such a blade assembly, of means movable to expose the cutting edge of the blade for shaving or to withdraw it so that it cannot harm anyone handling the blade assembly.

It is known from GB-A-No. 2,066,131 to provide a razor blade assembly comprising a guardbar, a top cap and a blade in which the top cap is slidable between a position in which the blade edge is exposed, and a position in which the blade edge is covered by the top cap. It is also known from U.S. Pat. No. 4,265,015 to mount the blade for sliding movement in the plane of the blade unit and out of a shaving position. In each of these known devices, the relative position of the blade and top cap is changed by each movement into and out of the shaving position, and accurate blade exposure is therefore difficult to achieve.

BRIEF SUMMARY OF THE INVENTION

According to the present invention, there is provided a razor blade assembly comprising at least one blade having a cutting edge, a guardbar, and a top cap which covers a substantial part of the, or each, blade and cooperates with the guardbar in locating the or each blade edge correctly with respect to the skin of a person shaving, and means mounting the guardbar for movement relative to the top cap from a position in which the, or each, blade edge is correctly exposed for shaving, to a position in which the guardbar screens the, or each, blade from contact with a person handling the blade assembly.

More particularly the guardbar is mounted for rotational movement relative to the top cap between the shaving position and the screening or protecting position of the guardbar. In the latter position of the guardbar, the blade is no longer exposed.

BRIEF DESCRIPTION OF THE DRAWINGS

The invention will now be particularly described, by way of example only, with reference to the accompanying drawings in which.

DETAILED DESCRIPTION

Figure 1:
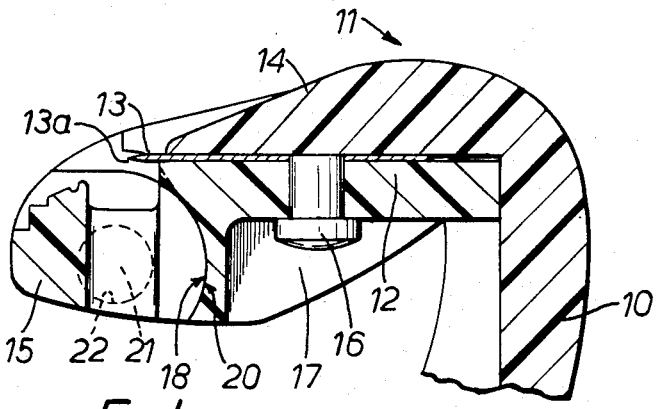
FIGS. 1 and 2 are cross-sections through a first embodiment of a razor in accordance with the invention showing the 'shaving' and 'non-shaving' positions respectively of the razor blade.
Figure 2:
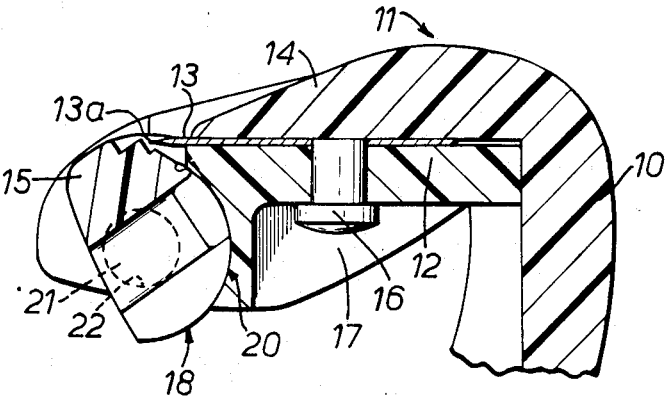
Figure 3:
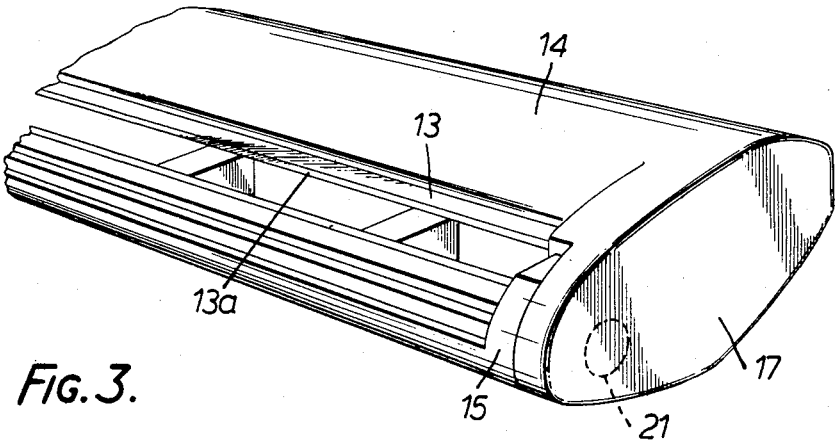
FIG. 3 is a perspective view of the head of the razor of FIG. 1.

The razor illustrated in FIGS. 1, 2 and 3 of the accompanying drawings is formed by a handle 10 at one end of which is a razor head 11. The head 11 is formed by a blade supporting platform 12 rigidly secured within the head 11, a blade 13 supported on the platform 12, a top cap 14 disposed above the blade and secured to the platform, and a guardbar 15 mounted at the front of the blade platform 12.

End walls 17 integral with the platform 12 extend upwardly above the plane of the blade and receive the top cap therebetween. The top cap is preferably secured to the platform 12 by rivets 16 which pass through the blade and secure the blade to the platform and to the top cap and handle unit.

If desired, a second blade can be secured to the top cap, spaced from and in staggered relationship to the first blade, in a manner well known in the art.

The guardbar 15 is a component formed separately from the blade platform but having a part-cylindrical surface 18 engaging a correspondingly shaped recess 20 in the forward end of the blade platform. The guardbar has pivot pins 21 at its opposite ends on the axis of the cylindrical surfaces which is parallel to the cutting edge of the blade, the pivot pins being received in recesses 22 in the end walls 17. The guardbar can thus be rotated about the axis of the pins 21 from the 'shaving' position shown in FIG. 1 to a 'non-shaving' position in FIG. 2. In the position of FIG. 1, the cutting edge 13*a* of the blade 13 is so positioned, relative to a tangent plane from the upper surface of the guardbar to the forward upper edge of the top cap 14, as to give the correct blade exposure for shaving. In the position of FIG. 2, although the blade 13 has remained stationary relative to the top cap 14, the pivotal movement of the guardbar 15 has moved this tangent plane away from the cutting edge of the blade sufficiently to render the razor inoperable for shaving, or in other words to place the cutting edge of the blade in a 'non-shaving' position. The head of the razor can then be handled with safety. Stops are suitably located on the guardbar 15, to locate it in the 'shaving' and 'non-shaving' positions respectively relative to the platform 12.

Figure 4:
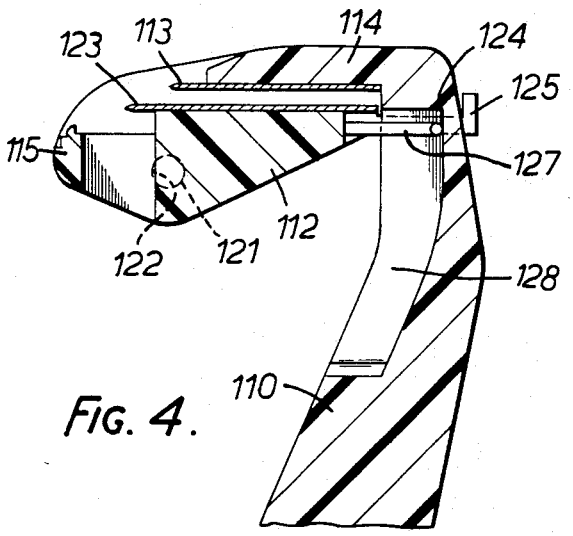
FIGS. 4 and 5 are cross-sections through a second embodiment of a razor in accordance with the invention having twin blades and showing the blades in a 'shaving' position and in a 'non-shaving' position respectively.
Figure 5:
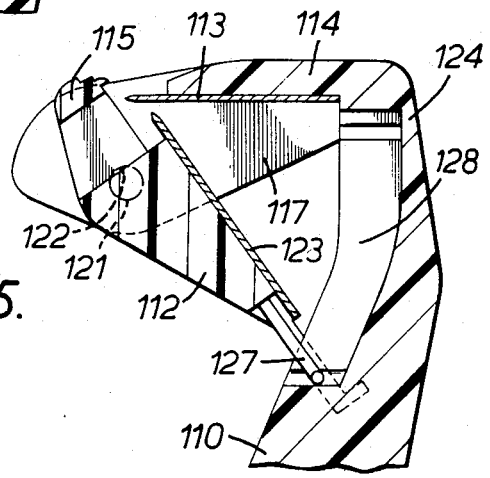
Figure 6:
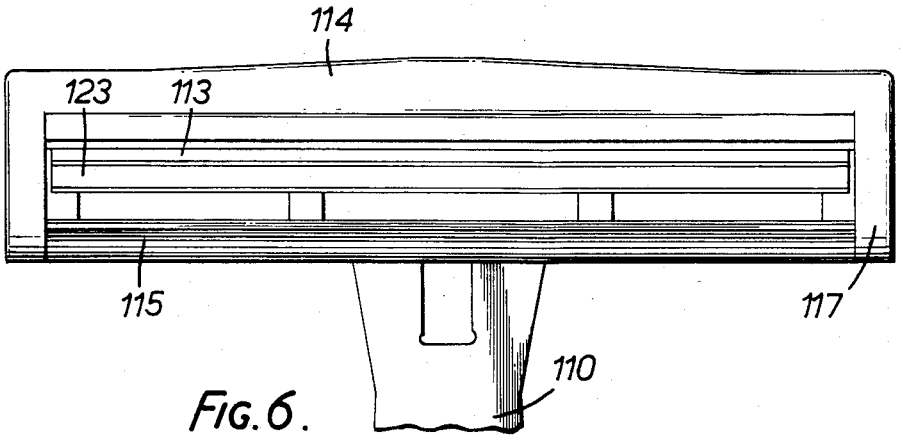
FIGS. 6 and 7 are respectively a front elevation and the rear elevation of the razor of FIGS. 4 and 5.
Figure 7:
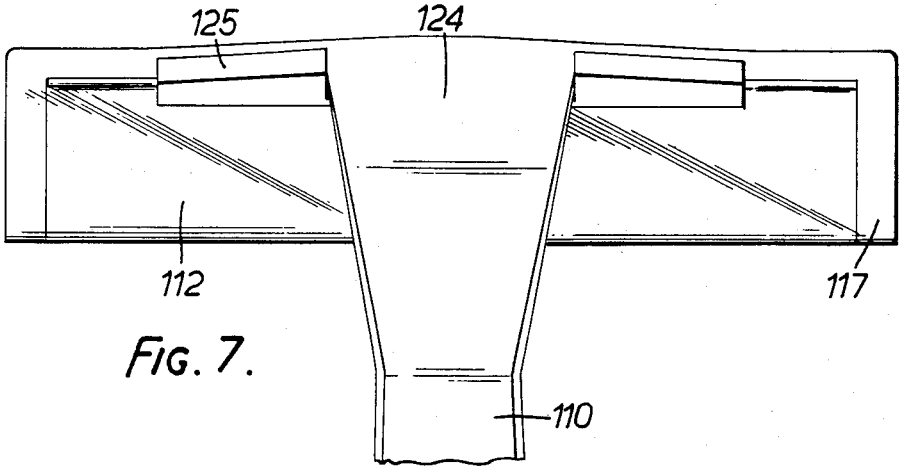

The same principle is utilised in the second embodiment of the razor as shown in FIGS. 4 and 5.

In this twin-bladed embodiment, the razor head is formed by a pair of end walls 117, a top cap 114 integral with the end walls, and a rear wall 124 integral with the end walls 117, the top cap 114 and a handle 110.

A guardbar 115, in this embodiment, is formed integrally with a blade platform 112 on which a first blade 123 is secured. The guardbar and platform combination is provided with pivot pins 121 which engage in recesses 122 in the end walls 117, when the end walls are flexed apart to receive the pins 121. A second blade 113 is secured to the underside of the top cap 114.

The cutting edges of the blades 113 and 123 are so staggered and so located with respect to the tangent plane from the guardbar 115 to the front upper edge of the top cap 114, in the position of the components shown in FIG. 4, that they are correctly positioned for shaving.

However, if the guardbar 115, platform 112 and blade 123 are swung about the axis of pivot pins 121 into the position shown in FIG. 5, the guardbar operates as a notional cam to raise the above-mentioned tangent plane away from the cutting edge of blade 113, and simultaneously the cutting edge of blade 123 retreats away from this tangent plane, in both cases rendering the razor inoperable for shaving, and safe against anyone handling the head of the razor.

To facilitate pivotal movement of the guardbar and blade platform, an operating lever 125 extends rearwardly from the blade platform 112 on opposite sides of the handle 110 for engagement by the thumb of the user. Furthermore a forked detent 127 is provided on the rear end of the platform 112 for engagement under lateral pressure in a slot 128 in the razor handle. The slot is wider at its opposite ends than intermediate its ends, so that when the forked detent 127 engages the ends of the slot, it expands to lock the platform 112 and guardbar 115 resiliently either in the 'shaving' position as in FIG. 4 or in the 'non-shaving' position as in FIG. 5.

The embodiment of FIGS. 4 and 5 could be modified to provide a single blade version by omitting the blade 123, and suitably modifying the spacing between the remaining blade 113 and the guardbar 115.

In the embodiment of FIGS. 8, 9, 10 and 11, a blade 213 is secured to the underside of a top cap 214 which is integral with a handle 210. In this embodiment, a guardbar 215 is integral with a platform 212 and with a thumb plate 230, the integral guardbar, platform and thumb plate being pivoted on pivot pins 221 for rotation about an axis parallel to the cutting edge of the blade and substantially midway between the guardbar and thumb plate. The platform 212 serves to carry only the guardbar and thumb catch, and does not carry a blade. Nevertheless, in the shaving position of FIG. 8, the platform 212 will assist in supporting the single blade.

The pivot pins 221 are engaged in corresponding recesses in parallel spaced end walls 217 which are integral with the handle 210 and top cap 214, the end walls 217 being sufficiently flexible to permit the pins 221 to be engaged with the corresponding recesses.

Figure 8:
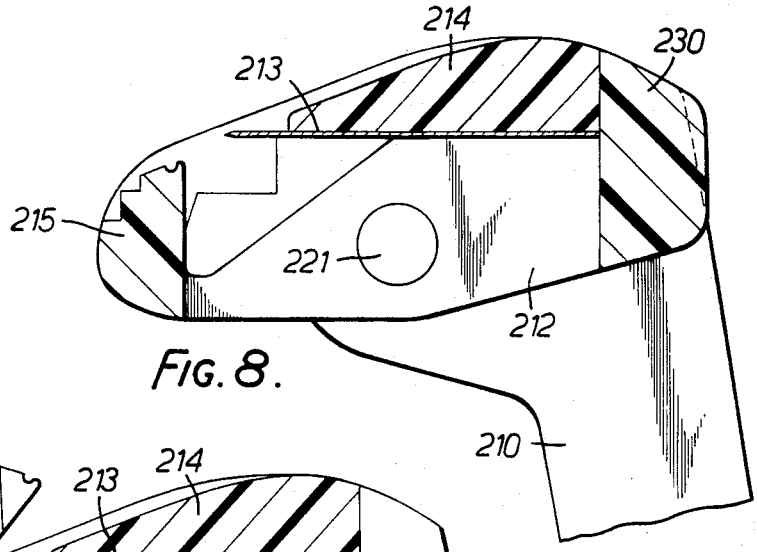
FIGS. 8 and 9 are cross-sections through a third embodiment of a razor in accordance with the invention having a single blade, and showing the blade in a 'shaving' position and in a 'non-shaving' position respectively.
Figure 9:
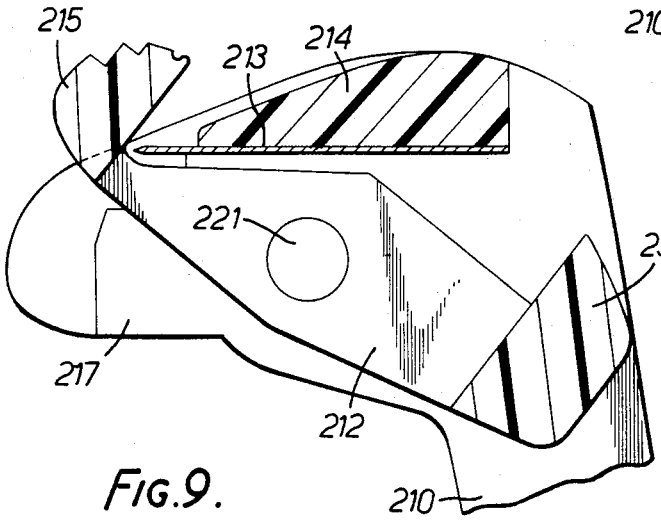
Figure 10:
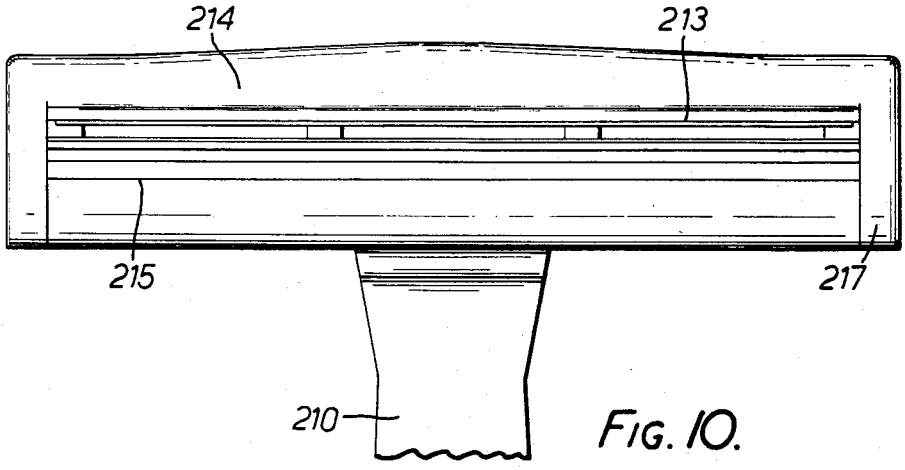
FIGS. 10 and 11 are respectively a front elevation and a rear elevation of the razor of FIGS. 8 and 9.
Figure 11:
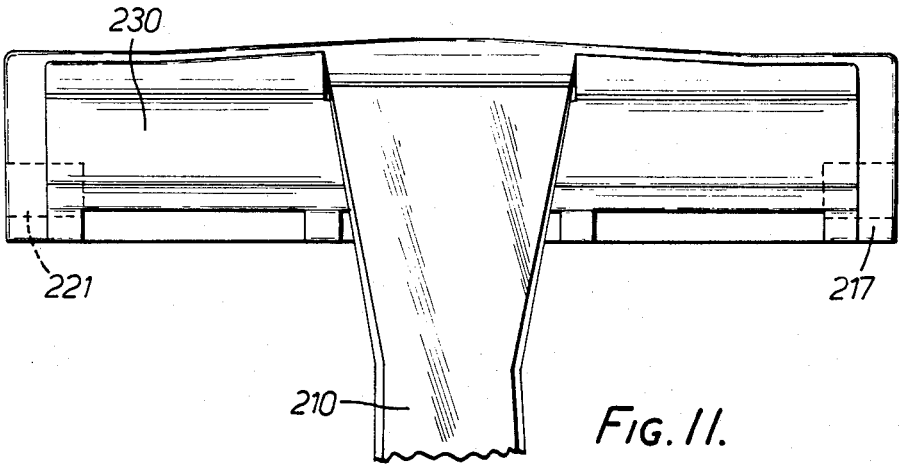

As shown in FIG. 8, the guardbar 215, platform 212 and thumb plate 230 are located in the shaving position of the razor in which the cutting edge of blade 213 is correctly located relative to the tangent plane to the guardbar 215 and top cap 214. The movable parts of the razor are held in this position by suitable detents not shown. If the user of the razor now applies thumb pressure downwardly on thumb plate 230, sufficient to overcome the retaining force of the detents, the assembly of guardbar 215, platform 212 and thumb plate 230 is rotated into the position shown in FIG. 9. In this position, the assembly is so located that the cutting edge of blade 213 is received in the recess defined between the guardbar 215 and the platform 212. The guardbar thus screens the cutting edge of the blade so that the danger of the user cutting himself on the blade is removed. This is a 'non-shaving' or 'travel' position of the razor and the movable parts of the razor are secured resiliently in this position by detents not shown. Simple upward pressure on the thumbplate will return the movable parts of the razor to the 'shaving' position shown in FIG. 8.

I claim:

1. A razor blade assembly comprising a pair of blades each having a cutting edge; a guardbar; a top cap which covers a substantial portion of each blade and cooperates with the guardbar in locating the blade edges correctly with respect to the skin of a person shaving; and means mounting the guardbar for movement relative to the top cap from a position in which each blade edge is correctly exposed for shaving, to a position in which the guardbar screens each blade from contact with the person handling the blade assembly, said mounting means including a platform pivotable relative to said top cap and on which the guardbar is rigidly mounted, one of said blades being rigidly secured to the top cap and the other of said blades being rigidly secured to the platform, said blade edges being staggered with respect to each other when correctly exposed for shaving.

2. A razor blade assembly according to claim 1; wherein the means mounting the guardbar for movement permits the guardbar to rotate about an axis parallel to the cutting edges of the blades between said positions.

3. A razor blade assembly according to claim 1 having parallel spaced side walls rigid with the top cap and supporting the means for mounting the guardbar.

4. A razor blade assembly according to claim 1 which includes a handle integral with the top cap said platform having thereon a member engageable by the finger or a person gripping the handle, the member being secured to the platform so that movement of the member about said axis will cause pivotal movement of the guardbar.

* * * * *